US005087310A

United States Patent [19]

Robinette

[11] Patent Number: 5,087,310

[45] Date of Patent: Feb. 11, 1992

[54] WALLBOARD BUNDLING TAPE AND METHOD

[76] Inventor: Joseph R. Robinette, 221 Maple Tree Dr., Bristol, Tenn. 37620

[21] Appl. No.: 460,587

[22] Filed: Jan. 3, 1990

[51] Int. Cl.[5] ..... B32B 31/00

[52] U.S. Cl. ..... 156/202; 156/216; 428/43; 428/122; 428/194; 206/451; 229/123.2

[58] Field of Search ..... 428/43, 192, 194, 122; 156/202, 216; 206/451, 608, 611

[56] References Cited

U.S. PATENT DOCUMENTS 1,827,636 10/1931 Ames ..... 428/194

4,936,464 6/1990 Kim ..... 206/617

*Primary Examiner*—Alexander S. Thomas

*Attorney, Agent, or Firm*—Mason, Fenwick & Lawrence

[57] ABSTRACT

A bundling tape has two rows of perforations extending from one end of the tape to the other; the perforations are arranged inward of and substantially parallel to the edges. A first band is formed between one edge and a first row of perforations, and a second band is formed between the other edge and the second row or perforations; between the two rows of perforations is a center band tear strip. The bands have co-planar upper and lower surfaces. Adhesive is applied only to the bottom surfaces of the first and second band; there is no adhesive on the center band. Bundles of material, such as wallboard, are fastened together by adhering the bottom surface of the first band to the uppermost sheet of material, and by adhering the bottom portion of the second band to the lowermost sheet.

7 Claims, 1 Drawing Sheet

WALLBOARD BUNDLING TAPE AND METHOD

FIELD OF THE INVENTION

This invention is directed to forming bundles of material and in particular to forming bundles comprising two sheets of wallboard or sheet rock.

BACKGROUND OF THE INVENTION

Wallboard is frequently used as a wall material in home and commercial construction. Wallboard, often referred to as gypsum wallboard or sheet-rock, is normally shipped in bundles of two rectangular sheets which are held together by a printed paper tape called bundling tape applied along the edges of the sheets. The bundling tape is applied to the edges of the two sheets of wallboard at the gypsum manufacturing plant; the tape can either have pre-applied adhesive on the back, or the adhesive can be applied to the back of the bundling tape immediately at the point of application to the wallboard.

Typically, wallboard has a smooth surface on one side and a coarse or tougher surface on the other side. The smooth surface will ultimately face outward into the room where the wallboard is installed. The coarse backing surface is generally tougher, and there is little concern if the coarse back sheet is scratched or nicked in transport. For this reason the bundles are usually formed with the smooth surfaces facing one another and with the rough or coarse surfaces facing outward.

With reference to FIG. 1, a prior art wallboard bundle 115 is illustrated. An upper sheet 117 has its downwardly facing smooth surface facing, and resting upon, the smooth upwardly facing surface (not shown) of lower sheet 119 rough surface 116 on upper sheet 117 is facing upward while the rough surface (not shown) of lower sheet 119 faces downward. Sheets 117 and 119 are generally rectangular in shape, and have side edges 112 and end edges 114. To economize on space in shipping, and to facilitate the formation of bundles, sheets 117 and 119 are arranged so that the side edges 112 and the end edges 114 are co-planar With the edges of the other sheet in the bundle. A small gap 144 may be visible between the two sheets due to slight manufacturing imperfections, and due to the paper which is generally bonded to the gypsum or other material making up the wallboard.

Sheets 117 and 119 are fastened together through the use of prior art bundling tape 110 which is applied to end edges 114 and which overlaps onto rough surfaces 116. A zipper tape 111 is placed over the gap 144 when the bundling tape 110 is applied. The bundling tape 110 adheres to the zipper tape a well as to the end edges 114 and rough surfaces 116. Generally, the zipper tape 111 extends to corners 154 where rough surfaces 116 and end edges 114 meet. Zipper tape is generally formed from a roll of "liner board" which is approximately three times thicker than the bundling tape, and which is generally more rigid and stronger than the bundling tape.

The prior art bundling tape 110 is generally an elongated strip of paper, or other suitable material, which may have adhesive precoated across its entire bottom surface before application to the wallboard; in the alternative, the zipper tape back surface, the exposed portions of the end edges 114 and the portions of rough surfaces 116 adjacent to corners 154 may all be coated with adhesive so that bundling tape 110 may be adhered to the zipper tape and wallboard. Usually bundling tape 110 is applied at both ends of a bundle to form the complete wallboard package which is shipped.

When a carpenter is ready to use the prior art wallboard package, sheets 117 and 119 are separated by removing zipper tape 111 along with the center portion 134 of the bundling tape 110. To remove zipper tape 111 and center portion 134 of bundling tape 110, the carpenter must grip a first end 140 of zipper tape 111 and pull it away from edges 114; this leaves behind an upper band 132 and a lower band 134 of bundling tape 110. Bands 132 and 134 which remain behind have irregular rough edges 136, and the bundling tape 110 which remains attached to end edges 114 may interfere with the ability to align sheets 117 or 119 with the edge of other sheets or to join closely with flat surfaces. The zipper tape and attached center portion 138 of bundling tape 110 is usually thrown away, although in some cases, it may be recyclable.

The process of producing the prior art wallboard bundles requires special equipment to apply the zipper tape, and then to apply bundling tape over the zipper tape and to the edges and surfaces of the wallboard sheets. Since the zipper tape is approximately three times as thick as the bundling tape, but the rolls of the former and later usually have equal diameter, it is usually necessary to stop the manufacturing process three times to add new rolls of zipper tape for every one roll of bundling tape. Furthermore, it is necessary to carefully align the zipper tape so that the zipper tape covers the gap between the sheets of wallboard; this is so the bundling tape will not adhere to the end edges 114 in such a fashion that fragments of bundling tape remain across the gap after removal of the zipper tape. If sufficiently large portions of bundling tape remain attached across the gap, the wallboard pieces will not separate; use of a knife or sharp knife or sharp object would then be necessary to cut the bundling tape, and the cutting instrument may damage the wallboard.

The zipper tape is not only more difficult to apply, requiring extra equipment and extra processing steps, but is also more expensive due to the increased amount of material required; zipper tape increases the amount of material which is thrown away and also increases shipping weight. Furthermore the prior art zipper tape frequently leaves behind portions of bundling tape on the end edges of the wallboard which require removal in order to facilitate better engagement with an adjacent sheet edge or to reduce the size of cracks in a wall or ceiling.

There is thus a need for a wallboard bundling tape and bundling method which can dispense with the zipper tape of the prior art; yet also be easy to apply and remove, but which is less capable of accidental gluing of the gap between the wallboard sheets in a bundle or which is not capable of leaving substantial amounts of tape on the edges of the wallboard pieces after they are separated.

SUMMARY OF THE INVENTION

The present invention new bundling tape and method for fastening sheets of material together includes, in its preferred embodiment, provision of a tape which is an elongated strip that has two rows of perforations dividing the tape into three lengthwise extending bands. These bands comprise a first band and a second band located between the edges of the tape and the perforations, and a center band or tear strip sandwiched between the first and second bands and the two rows of perforations. In the preferred embodiment, the center band or tear strip is generally wide enough to encompass the combined width of the sheet edges and gap therebetween in a two sheet bundle of sheets. Adhesive is applied only to the surfaces of the first band and second band; their is no adhesive on the center band. The center band is easily removed by grasping one end of it and tearing it from the strip along its perforations.

It is therefore an object of the present invention to provide a new and improved bundling tape for fastening sheets of material together which is inexpensive to produce, easy to apply, and which permits easy separation of the sheets held together in bundles by the bundling tape.

It is a further object of the present invention to provide a bundling tape which does not adhere to any substantial portion of the edges of the sheets which are fastened together by the tape.

It is a further object of the present invention to provide a bundling tape which can be removed after application to a bundle without the use of an additional "zipper" tape or other tearing aid.

It is still a further object of the present invention to provide a bundling tape which can be used to fasten sheets of material together in a bundle in fewer process steps and with less equipment than the prior art.

Other objects and advantages of the subject invention will become apparent from the accompanying drawings and detailed description in which like reference numbers are used for the same parts as illustrated in the various figures.

DETAILED DESCRIPTION OF THE INVENTION

Figure 2:
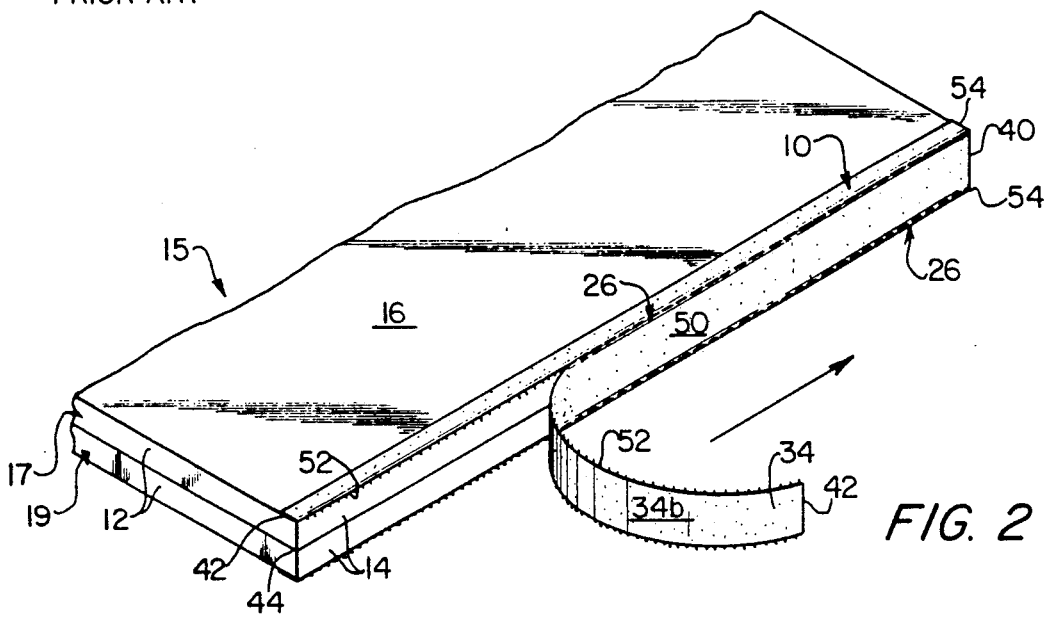
FIG. 2 is a perspective view of a preferred embodiment of a wallboard bundle formed with the preferred embodiment tape of the present invention, showing partial disengagement of a portion of the tape.

FIG. 2 illustrates a wallboard bundle 15 utilizing the bundling tape 10 comprising the preferred embodiment of the present invention. An upper sheet 17 lies upon a lower sheet 19. Both sheets 17 and 19 are generally rectangular in shape, and have side edges 12 and end edges 14; the edges of sheets 17 and 19 generally being co-planar. End edges 14 meet substantially planar, rough or coarse surfaces 16 at corners 54. Sheets 17 and 19 are arranged so that the rough or coarse surfaces 16 face outward and the smooth surfaces (not shown) are adjacent to, and facing, one another. A gap 44 may be seen between sheets 17 and 19, and is due to manufacturing irregularities and/or to the paper coating applied to the wallboard sheets which may make corners 54 slightly rounded, rather than perfectly square.

The wallboard sheets are generally made from gypsum or other suitable materials. The rough surfaces are usually coated with a special heavy grade of paper; the smooth surface, which will eventually form the visible portion of a wall, ceiling or other finished structure, generally is coated with a smoother textured fabric, paper or other coating to provide a smooth and attractive surface. The end and side edges are generally planar, and may be coated with paper, a plastic such as vinyl, or other material which protects the gypsum or other material making up the board from moisture and/or chipping.

The wallboard sheets are preferably shipped in bundles of two, with the smooth surfaces facing one another and the rough surfaces facing outward. Thus, the smooth surfaces are protected from damage during shipping; since the rough surfaces are generally not visible in the finished wall or structure, nicks and scratches in the rough surfaces caused by shipping and handling do not pose a problem. Furthermore, the heavy grade of paper used make the rough surfaces on the wallboards is tougher and less susceptible to damage. Wallboard is frequently cut to conform to architectural structure limitations, but the cut edges are generally not visible in the completed wall or structure.

Figure 3:
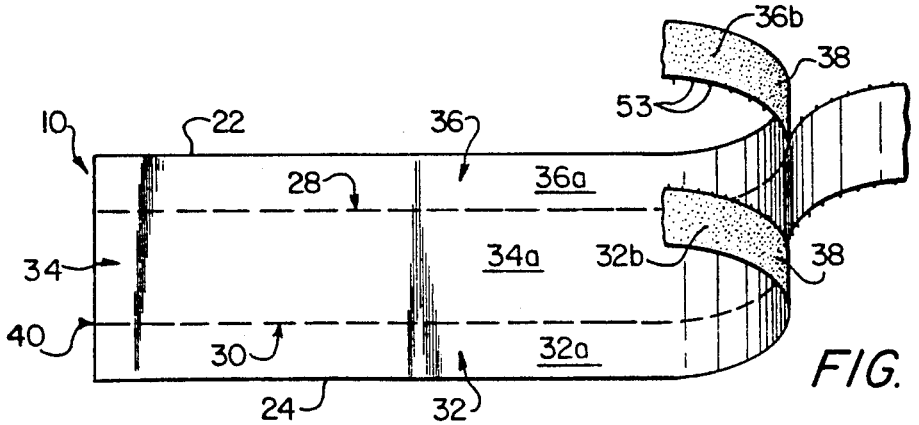
FIG. 3 is a perspective view of the preferred embodiment tape of the present invention, with a portion of the tape folded back upon itself to show the bottom surface of the tape as well as partial disengagement of the band portions forming the tape.

With further reference to FIG. 3, the preferred embodiment of bundling tape 10 is illustrated; tape 10 is in the shape of a generally rectangular, elongated strip or web with a first edge 22 and a second edge 24 which are substantially parallel to each other; edges 22 and 24 are also substantially parallel to rows of perforations or tear lines 26. Perforations 26 run from the first end 42 to the second end 40 of tape 10. A first row 28 of perforations 26 runs substantially parallel to first edge 22 to form a first band or securement strip 36. A second row 30 of perforations 26 runs substantially parallel to first row 28 and to second edge 24 forming a second band or securement strip 32. Thus, a center band or tear strip 34 is located between first row 28 and second row 30 of perforations 26. Bands 32, 34 and 36 have substantially co-planar upper surfaces **32*a*, 34*a* and 36*a*, and substantially co-planar bottom surfaces 32*b*, 34*b* and 36*b*. Adhesive 38 is only applied to bottom surfaces 36*b* and 32*b* of first band 36 and second band 32. There is no adhesive on either upper surface 34*a* or bottom surface 34*b* side of center band 34**.

The perforations 26 in tape 10 enable bands 32, 34, and 36 to be separated in a fashion similar to the way stamps may be torn from a sheet of stamps. The selvage, or border, about tape 10 is generally smooth, while the edges 52, which result from the separation of center band 34 from first band 32 and/or second band 36 are perforated. The perforated edges 52 have regular protuberances 53 which are preferably as small as possible.

Adhesive 38 may be a corn starch adhesive, a polyvinyl acetate or a standard gummed adhesive, such as is used on envelopes; any other suitable adhesive which is capable of bonding tape 10 to the sheets of material which are to be bundled together may also be used.

The tape 10 may be made from a bleached kraft paper, although other cellulosic or fibrous material may be used; it is also possible to use metal foils or plastics for the tape, although it may be necessary to use different adhesives depending on the type of material used to make the tape.

Figure 1:
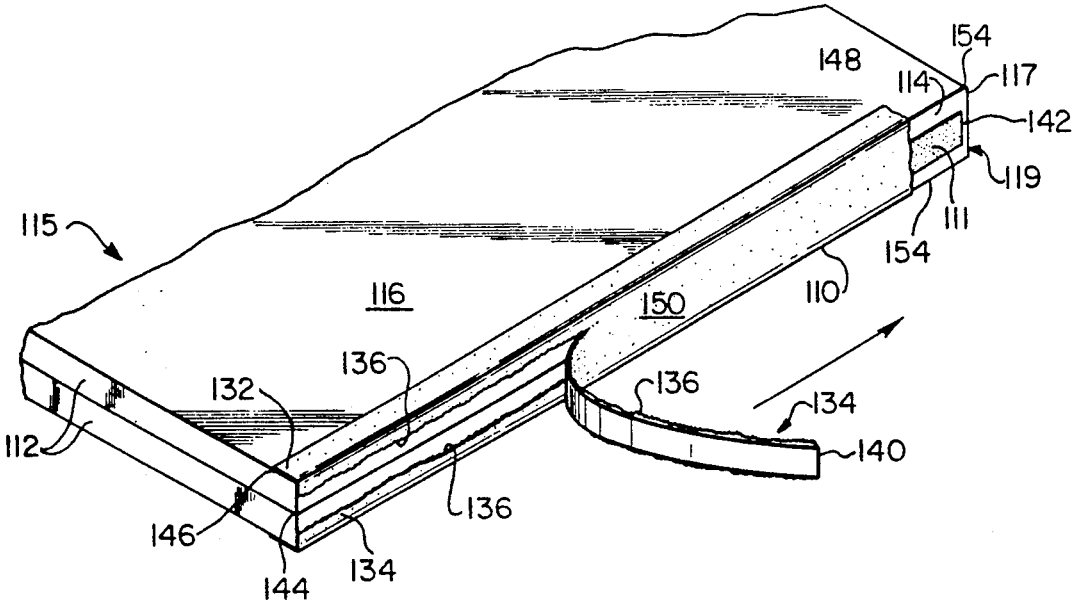
FIG. 1 PRIOR ART
FIG. 1 is a perspective view of a portion of a prior art wallboard bundle showing partial disengagement of the bundling tape and zipper tape.

Tape 10 may be applied to sheets 17 and 19 in a one-step process similar to the prior art processes, except that the additional equipment and steps necessary to apply the zipper tape over gap 44 is no longer necessary. The prior art processes required that the zipper tape 111 cover gap 144 so that there would be n accidental bonding of bundling tape 110 across gap 144 without intervening zipper tape 111. The new process involves the application of the uncoated bottom surface 34*b* of center band 34 across end edges 14 on sheets 17 and 19. It is preferred that center band 34 have a width which is approximately equal to the combined width of end edges 14 on sheets 17 and 19 with gap 44; thus, rows 28 and 30 of perforations 26 would be approximately aligned along corners 54. First band 36 and second band 32 are preferably ½ width, and preferably the adhesive 38 on the bottom surfaces 32*b* and 36*b* would adhere to rough surfaces 116 only. End surface 50, which is essentially upper surface 34*a* in the preferred embodiment, would face outward from the combined edges 14 so that information, such as the name of the manufacturer or retailer, grade or type of wallboard and relevant patent numbers, can be seen printed on end surfaces 50 (in the same fashion as information printed on the prior art surface 150 shown in FIG. 1).

In the preferred method of applying tape 10, first band 36 would be applied to a first or upper sheet 17 and second band 32 would be applied to a second or lower sheet 19. This may be performed sequentially or simultaneously. Tape 10 would preferably be applied at both ends of a bundle to form a completed wallboard package. The completed wallboard packages or bundles are then usually stacked so that pressure from upper bundles helps to ensure that bands 32 and 36 adhere tightly to the rough surfaces 16.

Although it is preferred that none of the adhesive coated bottom sides 32*b* and 36*b* of bands 32 and 36 be applied to end edges 14, the invention would still work better than prior art tapes if this were the case, provided that neither band 32 or 34 were to be applied across gap 44; however, this is easily avoided due to the width of center band 34 and with correct alignment of the roll of tape 10 which is to be applied to the end edges 14 of the wallboard.

To separate the wallboard pieces in a bundle, a carpenter or other user, would grasp center band 34 at first end 42 and pull the center band 34 away from bands 32 and 36, thus tearing tape 10 at perforations 26. Bands 32 and 36 will remain adhered to end edges 14, but in the preferred mode the perforated edges 52 would be aligned with corners 54 so that only the regular protuberances 53 would project over or beyond the edges 14. Protuberances 53 should not substantially interfere, in the preferred embodiment, with the ability of the end edges 14 to be aligned with the side edges or end edges of another piece of material.

Although, the preferred embodiment of tape 10 is intended for use at the end edges of bundles of two sheets of wallboard, it is envisioned that tape 10 could be used about side edges 12 instead of end edges 14, or about side edges 12 and end edges 14. Furthermore, it is also envisioned that tape 10 could be used to bundle together a wide variety of sheet-like materials, or to bundle a plurality of sheets located between a lowermost and an uppermost (or a "first" and a "second" sheet) with the bands 32 and 36 attached to the outer surfaces of the uppermost and lowermost sheets.

Although the preferred embodiment has been described and illustrated herein, it will be understood that various alterations, modifications, and substitutions may be apparent to one of skill in the art without departing from the central spirit of the invention. The scope of the invention is accordingly defined by the following claims:

I claim:

1. A method for bundling relatively rigid sheets of material together, comprising:

providing first and second aligned sheets of relatively rigid material each having an edge surface and upper and lower surfaces with the upper surface of the second sheet facingly engaging the lower surface of the first sheet, and fastening said sheets together by applying at least one piece of a perforated tape to said first sheet and said second sheet; said tape comprising an elongated strip, said strip having a first edge, a second edge and at least two rows of performations, said tape further comprising a first band extending from said first edge to a first row of said at least two rows of perforations, a center band extending from said first row to a second row of said at least two rows of perforations, a second band extending from said second row to said second edge; said bands having co-planar top sides and co-planar bottom sides; and adhesive means located on said bottom sides of said first band and said second band; wherein:

said fastening step further comprising the steps of:

adhering said adhesive means on said bottom side of said first band to said first sheet; and adhering said adhesive means on said bottom side of said second band to said second sheet, wherein:

said two sheets are wallboard, said sheets being rectangular in shape and having a smooth surface, a rough surface, and edges, said sheets being arranged with said smooth surface on said first sheet facing said smooth surface on said second sheet, at least one of said edges on each said sheet being co-planar with at least one edge on an adjacent sheet; and wherein said adhering step adheres said adhesive means on said bottom side of said first band and said second band to said rough surface on said first sheet and said second sheet.

2. The method of claim 1, further comprising the step of stacking said fastened sheets with other similar sheets so that said bands adhered to said rough surfaces are pressed against said rough surfaces.

3. A method of securing together two relatively rigid sheets of material having upper and lower surfaces and aligned edges; said method comprising:

(a) providing a fastening tape having a width greater than the combined thickness of said first and second sheets, first and second parallel tear lines extending lengthwise of said fastening tape to define a tear strip between said tear lines and first and second securement strips outwardly of said tear lines;

(b) adhesively securing said first securement strips to said first sheet so that said first tear line is aligned with one edge of said first sheet; and (c) adhesively securing said second securement strip to said second sheet so that said second tear line is aligned with an edge of said second sheet to secure said sheets together while permitting separation of said sheets following removal of said tear strip.

4. The method of claim 3 wherein said first securement strip is secured to the upper surface of the first sheet and said second securement strip is secured to the lower surface of said second sheet.

5. The method of claim 4 wherein said sheets are wallboard.

6. The method of claim 4 including simultaneously with step (b) adhesively securing a portion of said first securement strip to an upper edge portion of the aligned edge of said first sheet and adhesively securing a portion of said second securement strip to a lower edge portion of the aligned edge of said lower sheet.

7. The method of claim 6 wherein said sheets are wallboard.

* * * * *